United States Patent [19]

Jasper, Jr. et al.

[11] Patent Number: 5,005,462

[45] Date of Patent: Apr. 9, 1991

[54] LASER CONTROLLED SEMICONDUCTOR ARMATURE FOR ELECTROMAGNETIC LAUNCHERS

[75] Inventors: Louis J. Jasper, Jr., Fulton, Md.; Maurice Weiner, Ocean; Lawrence J. Bovino, Eatontown, both of N.J.

[73] Assignee: The United States of America as represented by the Secretary of the Army, Washington, D.C.

[21] Appl. No.: 466,142

[22] Filed: Jan. 16, 1990

[51] Int. Cl.[5] ..... F41B 6/00

[52] U.S. Cl. ..... 89/8; 124/3

[58] Field of Search ..... 89/8; 124/3

[56] References Cited

U.S. PATENT DOCUMENTS 4,343,223 8/1982 Hawke et al. ..... 89/8
4,431,914 2/1984 Mourou et al. ..... 250/211 J
4,546,249 10/1985 Whitehouse et al. ..... 250/227.11

OTHER PUBLICATIONS

Optically Activated Switch Technology, by Maurice Weiner, Dr., Lawrence J. Bovino, Mr., Terence Burke, Mr., Robert J. Youmans, and Mr., Melvin J. Wade—Presented at Army Science Conference Jun. 17-19, 1986, West Point, New York.

*Primary Examiner*—Stephen C. Bentley
*Attorney, Agent, or Firm*—Michael Zelenka

[57] ABSTRACT

An electromagnetic launcher or railgun includes a projectile or armature which is comprised of an optically activated semiconductor switch device including a body of bulk semiconductor material, such as gallium arsenide (GaAs) or gallium arsenide doped with chromium (Cr: GaAs), located between a pair of rails across which is connected a relatively high current source. A source of optical energy, such as a pulsed laser, directs optical energy to at least one surface of the semiconductor switch device where the conductivity of the semiconductor body is thereby increased and current from the source is transferred between the rails through the semiconductor body, causing an electromagnetic Lorentz type drive force to be built up behind the armature, which is set into motion and rapidly accelerated along the rails.

10 Claims, 2 Drawing Sheets

LASER CONTROLLED SEMICONDUCTOR ARMATURE FOR ELECTROMAGNETIC LAUNCHERS

The invention disclosed herein may be manufactured, used and licensed by or for the Government of the United States of America for governmental purposes without payment to us of any royalty thereon.

BACKGROUND OF THE INVENTION

This invention relates generally to the field of electromagnetic launchers, and more particularly to a light activated semiconductor switch device for use as a projectile/armature in a railgun.

Electromagnetic launchers or railguns are devices well known in the art and include a projectile or armature sliding between two parallel rails with the projectile/armature acting as a sliding switch or an electrical short between the rails. By passing a large current down one rail through the armature and back along the other rail or through a plasma arc behind the armature, a large magnetic field is built up behind the armature projectile accelerating it to a very high velocity by the Lorentz force generated behind the projectile/armature. Unlike conventional and light-gas guns, railguns employ an electromagnetic driving force and therefore can achieve projectile velocities which are not limited to the sonic velocity of a driving gas.

One of the main problems associated in the design of railgun systems, however, is the power supply and switching mechanism which must be able to supply large amounts of energy and high current levels, i.e. megamperes. Depending upon the particular application, the switch must operate at pulse repetition frequencies of many times a second, typically 50 pps. with rise times in the microsecond range.

Accordingly, it is an object of the present invention to provide an improvement in electromagnetic launchers.

It is another object of the invention to provide an electromagnetic launcher including a combined armature and switch mechanism.

It is a further object of the invention to provide an electromagnetic launcher which includes an expendable one shot armature/switch which operates at relatively high repetition rates.

It is yet another object of the invention to provide an electromagnetic launcher which includes a low cost yet reliable semiconductor switch type armature for tailoring the current profile flow through the armature.

And yet still another object of the invention is to provide an electromagnetic launcher including a semiconductor switch type projectile/armature which demonstrates reliability, high-power handling capability and which can provide variable current rise times and pulse-widths by controlling the intensity and time duration of a laser light beam.

SUMMARY

Briefly, the foregoing and other objects of the invention are provided by an armature for an electromagnetic launcher or railgun comprised of an optically activated semiconductor switch including a body of Group III–V semiconductor material, such as GaAs or Cr:GaAs, located between a pair of rails coupled to a high current source. A source of optical energy, such as a pulsed laser, directs optical energy to at least one surface of the semiconductor switch device whereupon the conductivity of the semiconductor body is increased and controlled by the frequency and power output of the laser which in turn controls the current transferred between the rails. This causes a Lorentz type electromagnetic driving force to be built up behind the armature, which is set into motion and rapidly accelerated along the rails in a predetermined direction away from a starting position.

BRIEF DESCRIPTION OF THE DRAWINGS

The following detailed description of the invention will be more readily understood when considered in conjunction with the accompanying drawings wherein.

DETAILED DESCRIPTION OF THE INVENTION

Figure 1:
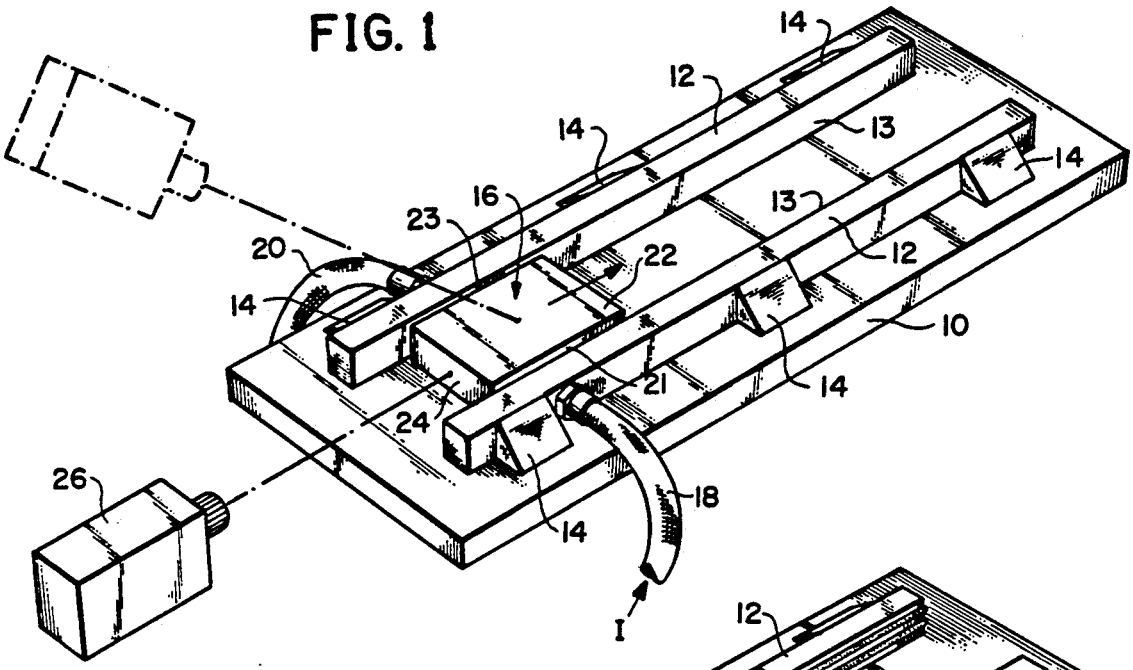
FIG. 1 is a perspective view schematically illustrative of a railgun according to a first embodiment of the invention.

Referring now to the drawings wherein like reference numerals refer to like parts throughout, reference will first be made to FIG. 1 wherein reference numeral 10 denotes a base or platform upon which a pair of elongated parallel rails 12 are mounted, being held in position by a series of restraining blocks 14. It should be noted that this configuration is merely a schematic representation inasmuch as the particular application will dictate the actual design. What is intended to be illustrated is there exists a pair of opposing rails between which is located a projectile or armature 16 which acts as a sliding switch or short for supplying current between the rails 12 from a source not shown, but which is connected thereto by a pair of high power current conducting cables 18 and 20.

Furthermore, the armature 16 in the embodiment shown in FIG. 1 is comprised of an optically activated semiconductor switch device which is shown as a rectangular block or bar located between the rails 12. The armature 16, moreover, comprises an expendable one-shot bulk semiconductor turn-on, turn-off toggle switch type of device whose conductivity is rapidly increased by the creation of current carriers due to the application of a relatively fast light pulse to at least one of its surfaces. The combined armature switch 16 is preferably comprised of a light sensitive Group III–V compound and more particularly gallium arsenide (GaAs) or gallium arsenide doped with chromium (Cr:GaAs).

Figure 3:
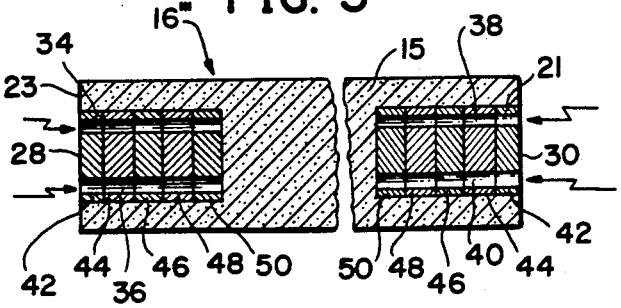
FIG. 3 is a lateral cross sectional view of a first type semiconductor switch armature utilized in the embodiment shown in FIG. 2.

The switch-type armature 16 accordingly comprises a bulk device of relatively high resistivity, typically being greater than $10^4$ ohms-cm upon which electrodes, not shown, are deposited on the surfaces contacting the inner surfaces 13 of the rails 12. One of the exposed surfaces, e.g. the upper surface 22 or the rear surface 24 of the semiconductor, is flooded with radiation from a pulsed laser 26, for example, which causes carrier pairs to be generated in the body 15 (as shown in FIG. 3) of the semiconductor, whereupon current will be transferred between the rails 12. While the armature switch 16 can be designed for high prf, low energy, or low prf, high energy, in the preferred embodiment of the invention, it comprises a low prf, high energy device which receives pulses from a laser which is controlled to provide, for example, 50 pulses per second of laser energy to the back surface 24 of the semiconductor armature 16. When desired, the energy can be applied to the top surface 22 as shown by the phantom view of the laser generator 26 or to both the back and top surface by using a mirror, not shown, to split the laser beam. The dynamics of the current response, i.e. the rise time, fall time, pulsewidth, amplitude, etc. depend on numerous factors such as the optical pulse shape, the pulse forming line, and the semiconductor properties of the bulk material from which the armature 16 is fabricated. One distinct advantage of this type of device has to do with the fact that the optical signal which controls the current between the rails 12 is completely isolated from the semiconductor circuit. Another advantage is to be able to rapidly control the current profile and hence the acceleration and velocity profile of the armature/-projectile.

Optically activated semiconductor switches are generally known and have been described in a printed publication entitled, "Optically Activated Switch Technology", which was published as a result of a paper delivered at the Army Science Conference in June, 1986, and authored by Maurice Weiner et al., one of the inventors of the subject invention.

It is to be noted that the armature switch 16 shown in FIG. 1 normally operates in a mode below the field of thermal avalanche condition of the semiconductor material because once avalanche starts, current control is lost. In its preferred form, the light intensity is defined by the pulse output from a Q switched Nd:YAG laser generator 26 which controls the current profile of the current flowing between the rails 12. In the event that an avalanche or runaway condition is desired, the width of the armature switch 16 can be considered as a solid state arc carrying current between the outer side surfaces 21 and 23. With respect to the laser generator 26, a typical example comprises a commercially available laser diode generator Model LDT-391 manufactured by Laser Diode Laboratories. Such apparatus operates at a wavelength of 0.904 microns and is able to deliver a peak power of approximately 700 watts while generating pulsewidths in the order of 50 nanoseconds.

Figure 2:
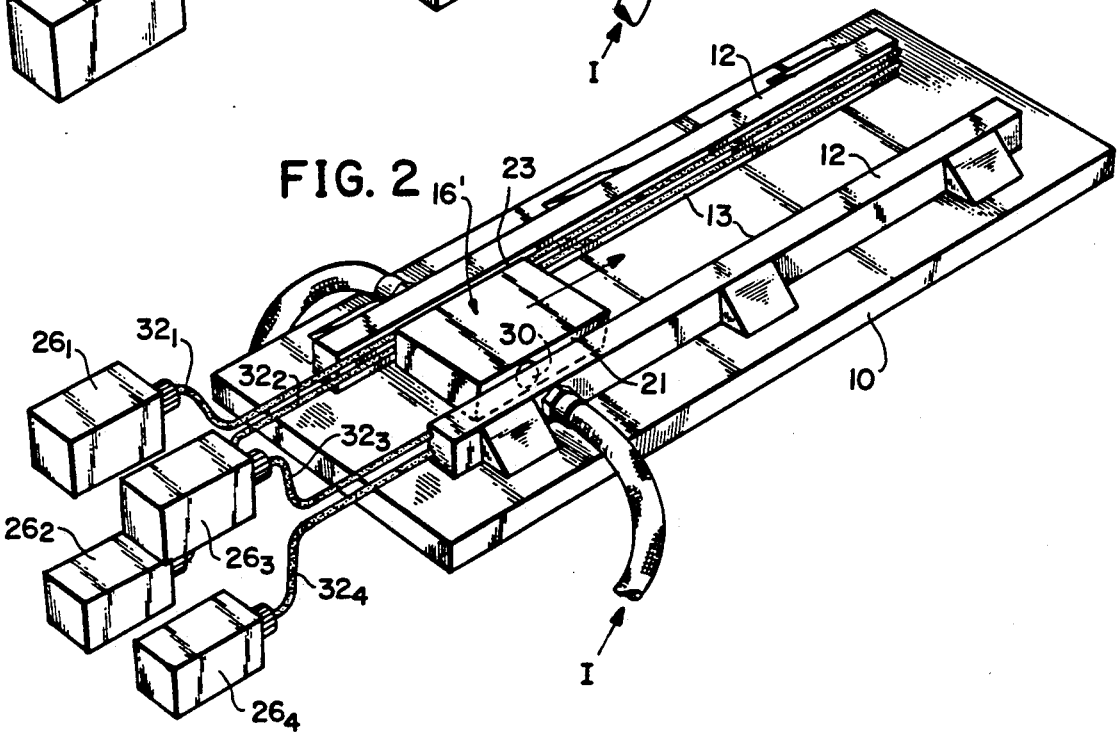
FIG. 2 is a perspective view schematically illustrative of a railgun incorporating a second embodiment of the invention.

Referring now to FIG. 2, shown thereat is a second embodiment of the invention which involves irradiating on armature switch 16' along the side surfaces 21 and 23 through a pair of grided electrodes 28 and 30 (as shown more clearly in FIG. 3) which respectively face pairs of elongated optical waveguide members $32_1$, $32_2$ and $32_3$, $32_4$, which are embedded in elongated slots formed on the inner side surfaces 13 of the rails 12. The grids are required to allow the laser beam to strike the semiconductor materials. The optical waveguide members $32_1$, $32_2$, $32_3$, and $32_4$ are coupled at their respective near ends to individual laser generators $26_1$, $26_2$, $26_3$, and $26_4$, which are pulsed in synchronism or, alternatively, by one laser generator illuminating four optical waveguides that are adjacent each other at the source end.

Referring now to FIG. 3, the light emanating from the four optical waveguide members $32_1$, $32_2$, $32_3$, and $32_4$ shown in FIG. 2 is directed to pairs of holes 34, 36, 38 and 40 formed in the contacts 28 and 30 on either side of the armature switch 16'. Each of the contacts 28 and 30, moreover, are formed of contiguous layers 42, 44, 46, 48 and 50 where the outermost layer 42 comprises 4000 A of gold (Au), the next layer 44 comprises 1000 A of silver (Ag), the middle layer 46 comprises 200 A of germanium (Ge), the next innermost layer 48 comprises 450 A of Au and the innermost layer 50 comprises 50 A of nickel (Ni). The two sets of contact layers 28 and 30 are embedded into the side surfaces 21 and 23 to prevent breakdown and to concentrate the current flow to the interior region of the semiconductor body 15.

Figure 4:
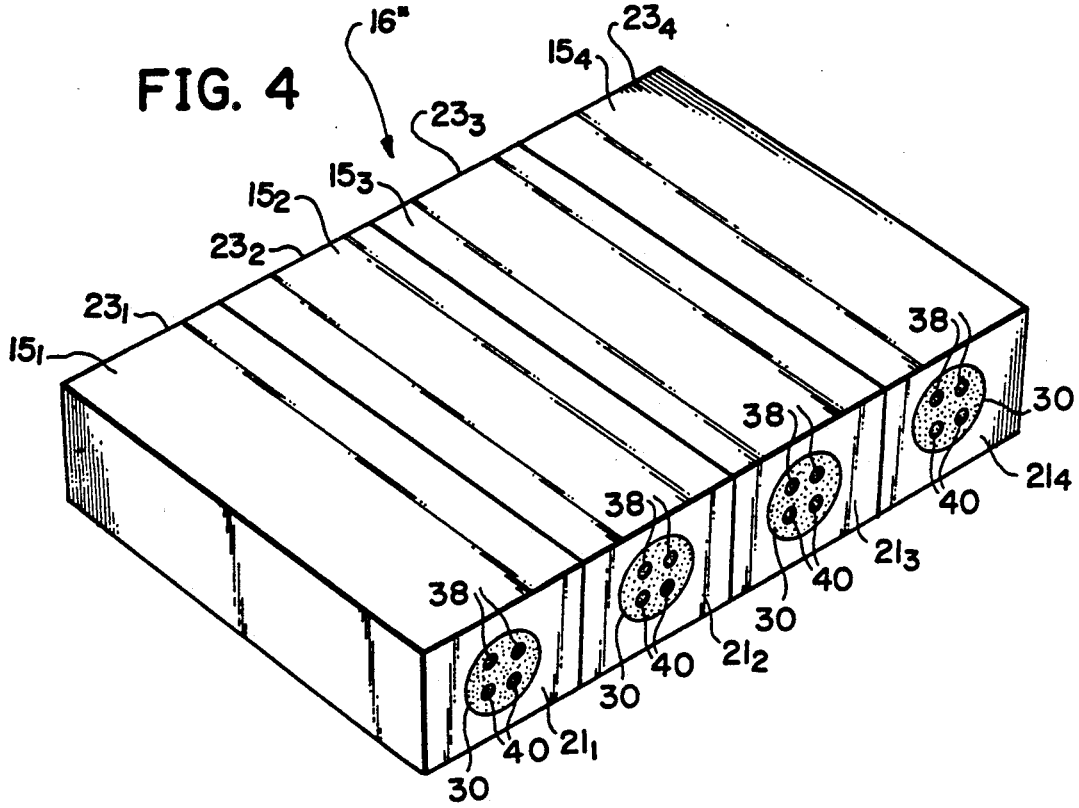
FIG. 4 is a perspective view illustrative of a multiple type semiconductor switch armature shown in FIG. 3.

When desirable, a plurality of semiconductor bars of generally rectangular cross section can be joined side by side as shown in FIG. 4 to form a composite armature switch 16''. As shown in FIG. 4, the armature switch 16'' is comprised of four semiconductor bars $15_1$, $15_2$, $15_3$, and $15_4$ which are joined along their elongated side edges. Four pairs of electrodes 28 and 30 accordingly are centrally located on the end faces $21_1$, $21_2$, $21_3$, $21_4$ and $23_1$, $23_2$, $23_3$, $23_4$, respectively. However, in FIG. 4 only the contacts 30 on the end faces $21_1$, $21_2$, $21_3$, and $21_4$ are shown.

When either a single or a multiple bar armature switch 16' or 16'' is located between the rails 12 as shown in FIG. 2, pulsed laser light appearing in the optical waveguide members $32_1$, $32_2$, $32_3$, and $23_4$ will switch up to 100,000 amperes per $cm^2$ between the rail faces 13, causing the armature to be accelerated to a high velocity by the Lorentz force built up behind the armature.

Figure 5:
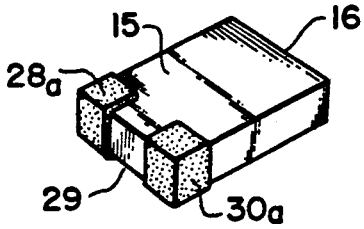
FIGS. 5, 6 and 7 are perspective views generally illustrative of second type semiconductor switch type armatures having variations of external contacts formed thereon.
Figure 6:
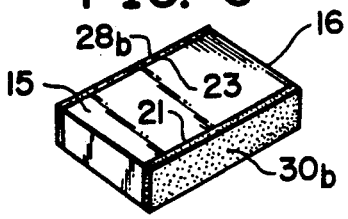
Figure 7:
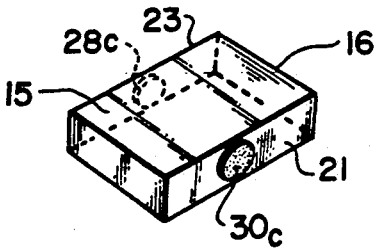

Referring now to FIGS. 5, 6 and 7, disclosed thereat are several variations of film type contacts which can be utilized in connection with a bulk semiconductor armature 16.

Considering now FIG. 5, the semiconductor body 15 of the armature 16 has a pair of external contacts $28_a$, and $30_a$ applied over the opposing rear corner portions of the semiconductor body 15. This type of armature switch would cause conductivity through the device to be concentrated at the rear end and also provide for surface conductivity and a gas plasma in the gap 29. With respect to the configuration shown in FIG. 6, the armature 16 again includes a bulk semiconductor body member 15, but now there is included a pair of electrodes $28_b$ and $30_b$ which covers the entire side surfaces 21 and 23. With respect to the configuration shown in FIG. 7, it discloses an armature 16 having a generally rectangular body 15 as opposed to an elongated bar and which has a pair of circular electrodes $28_c$ and $30_c$ formed on the outside surfaces of the sidewalls 21 and 23. In all three instances the electrode material comprises photoconducting material.

The optically activated switch type armature provides for tailoring the armature current profile by varying the optical intensity and duration and changing the rate of carrier generation. It is an important feature of the electromagnetic launcher of the subject invention to have the ability to control the current through the semiconductor switch type armature via the control of the light pulses applied thereto. It is particularly desirable to gradually increase the current flow through the armature so that damage to the rails is minimized. This is due to the fact that too rapid an acceleration of the armature/projectile from zero velocity can cause rail damage, particularly at the breech end of the railgun. Also, by controlling the current profile, one can control the velocity profile of the projectile. Thus a target can be hit without varying the inclination of the gun.

Having thus shown and described what is at present considered to be the preferred embodiments of the invention, it should be noted that the certain changes, alterations an modifications can be made without departing from the spirit and scope of the invention as defined in the accompanying claims.

We claim:

1. A railgun including a pair of opposing elongated parallel stator members coupled to a source of electrical current, comprising:

an armature comprising an optically activated semiconductor switch device including a body of semiconductor material located between said stator members; and a source of optical energy periodically energized to direct light energy to at least one surface of said semiconductor switch device, whereby light energy from said optical source increases the conductivity of said semiconductor body to initiate and control current flow between said stator members, causing an electromagnetic Lorentz type driving force to be built up behind said switch device which is then set in motion and accelerated in a predetermined direction between said stator members;

said stator members of said railgun comprising a pair of linear rails, said pair of rails additionally including optical waveguide means, coupled to said source of optical energy, located in mutually opposing inner side surfaces thereof and extending for a predetermined distance along the length thereof, and said body of semiconducting material including a pair of contact members respectively located adjacent said optical waveguide means for coupling optical energy into said body of semiconductor material.

2. The electromagnetic launcher as defined by claim 1, wherein each of said pair of contact members includes a plurality of metallic contact layers embedded in said body of semiconductor material.

3. The electromagnetic launcher as defined by claim 2 wherein said metallic contact layers include layers of gold, silver and nickel.

4. The electromagnetic launcher as defined by claim 3 wherein said layers include a pair of contiguous layers of nickel and gold, a pair of contiguous layers of gold and silver, and an intermediate contiguous layer of germanium between said pairs of contiguous layers.

5. The electromagnetic launcher as defined by claim 4 wherein said layers include at least one aperture therethrough for coupling optical energy into said body of semiconductor from opposite directions.

6. The electromagnetic launcher as defined by claim 1 wherein said pair of contact members are comprised of photoconductive materials for coupling optical energy into said semiconductor body and for enhancing current flow from rail/armature interfaces.

7. The electromagnetic launcher as defined by claim 6 wherein said contact members cover opposing rear corner regions of said semiconductor body and including a gap therebetween.

8. The electromagnetic launcher as defined by claim 6 wherein said contact members cover a predetermined portion of opposite side surfaces of said body of semiconductor material.

9. The electromagnetic launcher as defined by claim 8 wherein said contact members cover substantially all of said side surfaces.

10. The electromagnetic launcher as defined by claim 8 wherein said contact members cover a central region of said side surface.

* * * * *